United States Patent [19]

Chateau

[11] Patent Number: 4,790,160

[45] Date of Patent: Dec. 13, 1988

[54] LOCK HAVING LONGITUDINAL TUMBLERS

[76] Inventor: Michel M. Chateau, 9, rue Louis David, 75116 Paris, France

[21] Appl. No.: 20,874

[22] Filed: Mar. 2, 1987

[63] Continuation of PCT FR86/00237 filed Jul. 4, 1986 published as WO87/00232 Jan. 15, 1987.

[30] Foreign Application Priority Data

Jul. 5, 1985 [FR] France ..... 85 10354

[51] Int. Cl.[4] ..... E05B 23/00

[52] U.S. Cl. ..... 70/351; 70/387

[58] Field of Search ..... 70/350, 351, 376, 377, 70/387, 392, 405

[56] References Cited

U.S. PATENT DOCUMENTS

| | | | |
|---|---|---|---|
| 1,103,897 | 7/1914 | Ball | 70/405 |
| 2,595,267 | 5/1952 | Julliard | 70/387 |
| 3,326,024 | 6/1967 | Dreyfus et al. | 70/351 |

FOREIGN PATENT DOCUMENTS

| | | | |
|---|---|---|---|
| 597736 | 9/1925 | France . | |
| 238612 | 8/1925 | United Kingdom | 70/350 |
| 243259 | 11/1925 | United Kingdom | 70/405 |

*Primary Examiner*—Lloyd A. Gall

*Attorney, Agent, or Firm*—Arthur B. Colvin

[57] ABSTRACT

The invention relates to a lock comprising an assembly of identification plates provided with coding notches. A flat key, presenting a coded side, pushes the plates until their notches are brought into alignment, in which a feeler then comes into mesh by a rectilinear edge. The plates, continuing to slide under the thrust of the key, take along, via the feeler, a member for controlling the bolt. An alarm device indicates any introduction of an unsuitable key.

12 Claims, 4 Drawing Sheets

LOCK HAVING LONGITUDINAL TUMBLERS

BACKGROUND OF THE INVENTION

Related Application

This application is a continuous of PCT application No. PCT/FR86/00237 filed July 4, 1986, published as WO87/00232 on Jan. 15, 1987.

The invention relates to a lock comprising a member for controllinq a latch or bolt and a mechanism for actuating this member with the aid of a key bearing a code, via a code identification assembly comprising plates of generally substantially rectangular shape, of the same dimensions, juxtaposed in parallel with a determined pitch and slidably mobile in their longitudinal direction, each of these plates comprising, on a substantially rectilinear longitudinal side, a notch cut at one of several determined locations along this side, the notched sides of all the plates being disposed substantially in the same plane perpendicular to the planes of the plates, so that, into these notches brought into alignment by action of the key on the plates from their rest position, there may come into mesh, by a rectilinear drive edge that it comprises, a member for coupling the plates to the member controlling the bolt, this coupling member being adapted to transmit to said control member the movement imprinted on the key.

The invention has for its object to improve a lock of this type in order to render it particularly difficult to tamper with.

SUMMARY OF THE INVENTION

To this end, according to the invention, the coupling member is a sensing element or feeler which is doubly mobile, parallel to the direction of slide of the plates and substantially perpendicularly to the plane of the notched sides of the plates, this latter mobility affecting at least the drive edge that it comprises, which, being pressed against the assembly of the notched sides of the plates, is capable of engaging in the notches as soon as they are aligned and then of coupling the bolt control member to the plate assembly, with the result that, when introduced into the lock, the key takes along the plates which slide firstly in a stroke of positioning where their notches come into alignment if the key matches the lock, then in a complementary stroke where, if the feeler has been able to come into mesh by its drive edge in the aligned notches of the plates, the latter take along, via the feeler, the bolt control member in the direction of slide of the plates, in a direction tending to place the bolt in position of opening, while a means for returning the bolt control member in opposite direction is provided to return it into position of closure, this means preferably not enabling said member to be moved in the direction of opening.

Stop means should be provided for preventing the feeler from moving in the direction of slide of the plates as long as its drive edge has not come into mesh in the aligned notches of the plates. The feeler thus remains immobilized without being able to take along the member for controlling the bolt until said notches are brought into alignment, which can be obtained only by means of a key bearing the correct coding.

In an advantageous embodiment, the movement of the feeler substantially perpendicularly to the plane of the notched sides of the plates consists in a movement of pivoting about a pivot axis oriented in parallel to this plane and perpendicularly to the direction of slide of the plates, and movable in this direction.

More particularly, the pivot axis of the feeler may be defined by a pair of lateral lugs that it comprises and which are engaged in a pair of slots made in fixed walls of the lock in the direction of slide of the plates, the ends of these slots determining the end positions of the feeler in its displacements in this direction.

The feeler preferably comprises a second pair of lateral lugs located in the vicinity of its drive edge and engaged in a second pair of slots made in said fixed walls, each of these latter slots comprising a first part extending in parallel to the direction of slide of the plates and a second part, relatively short and oriented perpendicularly to this direction, the corresponding lug of the second pair of the feeler being located in this second part when this latter abuts on the plates while they are at rest and their notches are not aligned, this preventing the feeler from moving.

A lock according to the invention does not lend itself to manoeuvres of feeling for the purpose of discovering the coded combination that the plate assembly comprises. In fact, said plates do not oppose the introduction into the lock of a wrong key or any tool: they still slide, but without taking along the feeler. The lock may in addition be provided with an alarm device, adapted to detect and to indicate such manoeuvres, which compares the displacement of the member for controlling the bolt, or of the bolt itself, and that of the plates and is triggered off in the case of non-displacement of said member or of the bolt during the complementary stroke thereof, which is produced as soon as the object introduced into the lock does not effect alignment of the notches of the plates. This alarm device employs, for example, a switch which is fixed to the feeler or to the bolt control member and may be actuated by any one of the plates during said complementary stroke, for example via a transverse bar mobile in parallel to the plane of the notched sides of the plates and perpendicular to the direction of slide thereof, which may move in translation in this direction under the thrust of the plates against an elastic return force; upon withdrawal of the key, said bar further ensures return of the plates into rest position. In the preceding hypothesis of use of a wrong key, in order to avoid the movement of penetration thereof being able to be hindered by untimely catching of the notches of one or of certain of the plates on the drive edge of the feeler in the event of this edge being affected by a slight deformation or a slight offset with respect to its theoretical rest configuration, with the result that the wrong key would not trigger off the alarm device with which the lock is provided, the edge of the notch of each plate by which the drive edge of the feeler is capable of being attacked, should be provided to be joined by a bevel to the longitudinal side of the plate in which the notch is made.

The lock according to the invention is particularly advantageous when it is designed to operate with the aid of a flat key, comprising a front edge provided with cut-outs which show teeth and hollows succeeding one another in a determined coding combination; such a key, introduced into the lock, is capable of selectively pushing, by said front edge, the plates of the identification assembly and of positioning them with their notches aligned, then of causing them to execute their complementary stroke. In a very simple embodiment, the cut-outs of the front edge of the key determine a binary coding, each plate having its notch located in one of two determined locations over its length.

A lock according to the invention may be designed so that the key directly attacks the plates of the identification assembly, in their longitudinal direction of slide. When another direction of introduction of the key is desirable, there may be disposed, upstream of the plates of the identification assembly, an assembly of pivoting bevel gear parts, via which the key may actuate the plates by being introduced into the lock in a direction different from the longitudinal direction of the plates.

According to a feature of the invention, the bevel gear parts, all identical, are mounted freely in juxtaposition on a common transverse pivot pin; each of these parts, associated with a respective plate, is formed by a small plate located in the plane of this plate and comprising a first substantially radial arm, capable of pushing the corresponding plate and of thus actuating it in translation, and a second substantially radial arm, forming an angle with the first arm and capable of being attacked by the key introduced into the lock in said different direction. Two directions of introduction of the key are thus offered, depending on whether the key attacks the bevel gear parts by their first arm (being in that case introduced in the same direction as if it were directly attacking the plates), or by their second arm. These two directions form therebetween an angle which is a function of the angle of the first and second arms of the bevel gear parts. In particular, these arms may be arranged so that the two directions of introduction of the key are substantially perpendicular. In practice, these two directions may correspond respectively to the introduction of the key on the inside and on the outside of the premises defended by the lock.

In order to maintain the bevel gear parts at the pitch of spacing of the plates, which is equal to that of the teeth and hollows of the coded edge of the key, spacer members should be interposed between said parts, which are engaged at at least one point of their periphery in the notches of a transverse part in the form of a rack, the pitch of these notches being equal to the average pitch of the plates of the identification assembly. This latter pitch may itself be defined in similar manner by oblong spacer members, engaged at their ends in the notches of transverse parts in the form of a rack.

The coding notch that each plate comprises on its longitudinal side facing the feeler is advantageously located near its end opposite the one attacked by the key, with the result that the feeler, of which the drive edge is located in the vicinity of the notches of the plates, covers these latter only over a small length. If, in addition, it is provided that the second part of each of the slots of said second pair of slots is continued by a third part, of short length, oriented parallel to the first part, it is possible to cause the feeler to uncover and completely free the plates by placing it provisionally in a position of retraction where it is retained by its second pair of lugs engaged in said third part of the slots mentioned above.

When there is associated with each plate a stop which prevents it from moving in its plane perpendicularly to its longitudinal direction, if this stop is disposed near the end of the plate attacked by the key, it does not oppose the withdrawal of the plate in question, after retraction of the feeler, with a view to changing the code inscribed in the identification assembly of the lock. Such a change may be effected either by exchange of at least one plate with a plate bearing an otherwise positioned notch, or when each plate comprises a coding notch on each of its two longitudinal sides, these two notches having, however, a different positioning, by simple turning of at least one plate in its plane.

The above-mentioned stop, ensuring holding of each plate, may be constituted by a projection of the bevel gear part provided in association with the plate.

Other characteristics and advantages of the invention will be more clearly seen from the following description, with reference to the accompanying drawings, of non-limiting examples.

DETAILED DESCRIPTION OF THE PREFERRED EMBODIMENTS

Figure 1:
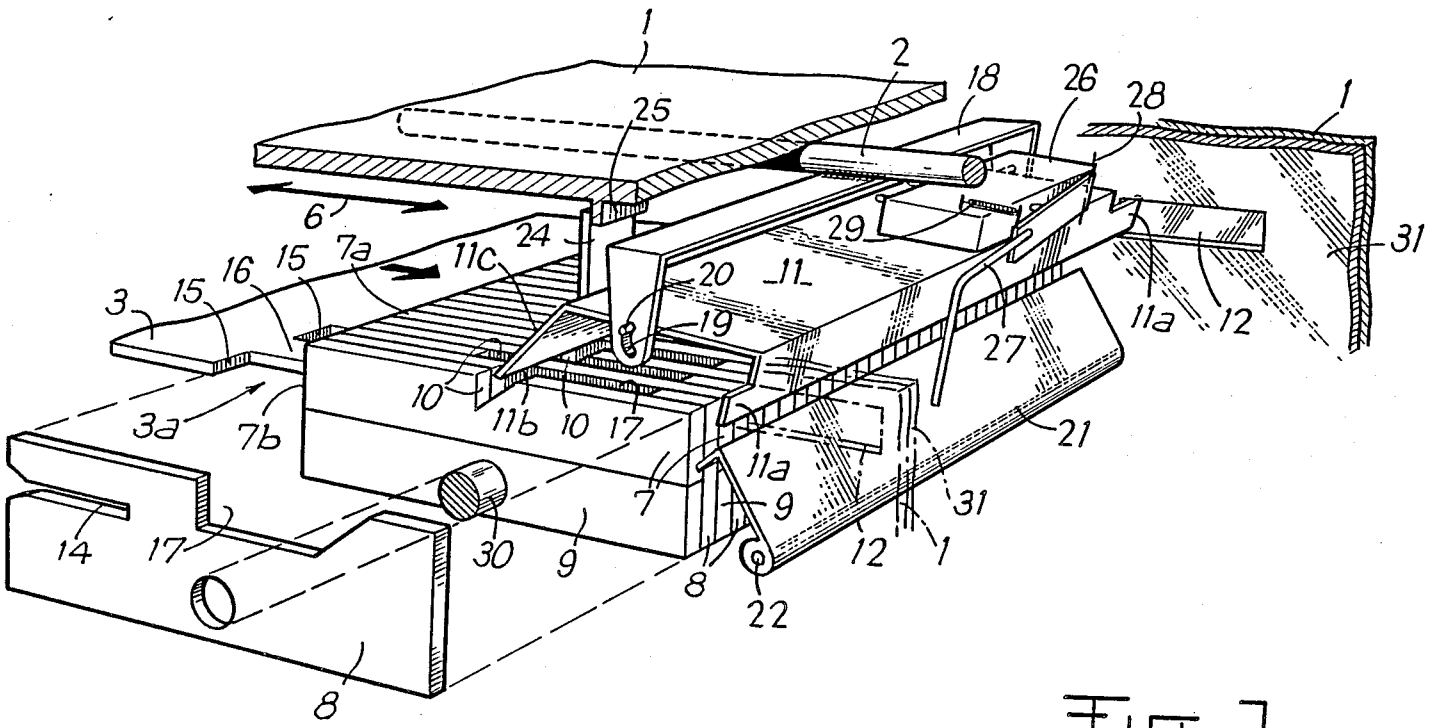
FIG. 1 schematically represents, in perspective, a lock according to the invention, only certain parts of its housing being shown.

The lock shown in FIG. 1 comprises a housing 1 through which may slide in translation a rectilinear rod 2, under the action of a flat key 3 introduced into the housing through an inlet slot 4, this key acting on the rod 2 via an internal mechanism which will be described hereinafter. One end 2*a* of the rod 2 constitutes the bolt of the lock, which may be engaged in a combined keeper 5 (FIG. 2*a*) or be withdrawn therefrom (FIG. 2*c*). Withdrawal of the bolt 2*a* from the keeper 5 is effected by introduction of the key 3, while its return into locked position in the keeper 5 is obtained with the aid of an actuation means (not shown), such as a spring or a manual rotating knob bearing an eccentric capable of pushing the rod 2 in the direction of the keeper 5. Of course, the bolt may also be constituted by a piece independent of the rod 2, but coupled thereto so as to be controlled by said rod. An intermediate part may also be provided between the bolt and the rod 2, such as a crank lever, when the direction of actuation of the bolt is different from the direction 6 of translation of the rod 2.

The mechanism of the lock comprises an assembly of oblong plates 7, which are mobile and guided so as to be able to slide longitudinally, in the direction 6 of translation of the rod 2, between small guiding plates 8 juxtaposed parallel to one another with interposition of spacer members 9 slightly thicker than the plates 7. The small plates 8 and the spacer members 9 are assembled on a transverse spindle 30 which traverses them all.

The plates 7 are identical in their general rectangular shape, and each offers a rectilinear side 7*a* freely flush between the small plates 8 in a common plane parallel to the direction 6. Each of these sides 7*a* is cut out with a notch 10 of triangular shape, to which is given one of two determined positions over the length of the plate, with the result that the series of notches 10 that the assembly of plates 7 comprises is disposed in accordance with a binary code defined by the respective positions of the successive notches when the plates are in rest position (FIG. 1).

Between the plate assembly 7 and the rod 2 there is mounted a feeler 11 constituted by a piece of sectioned sheet metal adapted to pivot about an axis defined by two lateral lugs 11*a* engaged in slots 12 which extend in two opposite walls of a chassis 31 inside the housing 1 parallel to the direction 6, and offering, on a border 1*c* located on the side opposite the said pivot axis, a rectilinear edge 11*b* applied against the sides 7*a* with notch 10 of the plates 7 by a low-power leaf spring 13 (FIGS. 2*a* to 2*d*). The edge 11*b* of the feeler 11 is, like its pivot axis, parallel to the plane of the sides 7*a* of the plates 7 and perpendicular to the direction 6 of displacement of the rod 2 (and of plates 7).

The slot 4 for introduction of the key 3 is located opposite the aligned ends 7*b* of the juxtaposed plates 7. It extends inside the assembly formed by these plates by a series of slots 14 made in the small guiding plates 8, these slots receiving the key 3 introduced into the lock through the inlet slot 4 and, more precisely, the front edge 3*a* of the key, which comprises a coding represented by cut-outs showing hollows 15 and teeth 16 which succeed one another in a determined code. The number of binary positions provided on the coded edge 3*a* is selected so as to obtain a very large number of possible combinations; for example, 32 binary positions provide several billions of different combinations.

Figure 2A:
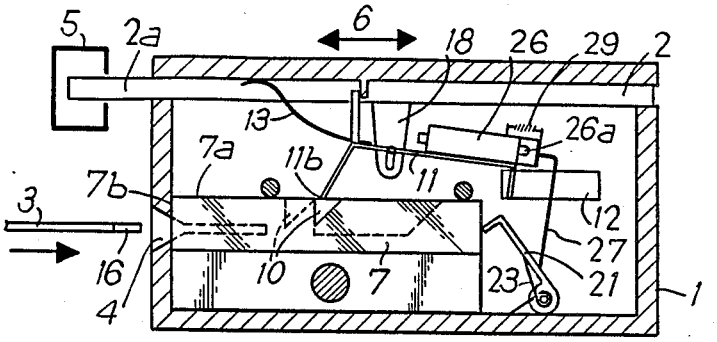
FIGS. 2*a* to 2*d* represent in longitudinal section the lock of FIG. 1 in different situations of operation.
Figure 2B:
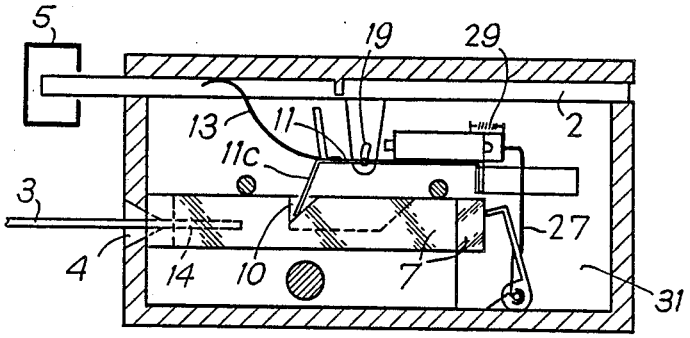

When key 3 is introduced into the lock, said key causes each of the plates 7 to move longitudinally in direction 6 by a determined quantity, respectively large or small, depending on whether it is attacked by a tooth 16 or by a hollow 15 of the front edge 3*a* of the key 3. When the code of the key corresponds to the code of positioning of the notches 10, the latter are brought into alignment and may then receive the rectilinear edge 11*b* of the feeler 11, which engages under the action of the leaf spring 13 (FIG. 2*b*).

The key 3 being pushed further into the lock, the plates 7 move all together under the thrust of the key, taking along in their movement of translation the feeler 11 in mesh by its edge 11*b* with the aligned notches 10. The displacement of the feeler 11 is not hindered by the small guiding plates 8, which comprise large notches 17 of which the length covers the whole stroke made by the notches 10 of the plates 7 at the time of the overall displacement thereof during their complementary stroke following their initial stroke of positioning of their notches.

The rod 2 is coupled in translation to the feeler by a stirrup member 18 which is welded thereon and offers at its ends holes 19 through which pass catches 20 fast with the feeler 11. This mode of coupling to the rod 2 does not hinder the pivoting movements of the feeler.

In this way, when the feeler 11 is driven in translation by the aligned notches 10 of the plates 7, it in turn takes along rod 2 up to an end-of-stroke position (FIG. 2*c*) where the bolt 2*a* which terminates it has left the keeper, ensuring the unlocking of the element such as a door on which the lock is mounted. At the same time, the plates 7, or at least those which correspond to teeth 16 of the key 3, repel a wide pivoting blade 21, embracing the whole plate assembly 7, which pivots about a fixed pin 2 perpendicular to the plane of the plates 7, against the force of a return spring 23. It is thanks to this spring that the blade 21 returns the plate assembly 7 into initial rest position (FIG. 2*a*) upon withdrawal of the key 3, the edge 11*b* of the feeler then escaping the notches 10 by rising along one of their sides, which, to that end, is given a certain inclination, the other side being perpendicular to the direction 6. It is generally suitable, as shown, that the border 11*c* bearing edge 11*b* offers, with respect to the plane of the notched sides 7*a* of the plates 7, an obliqueness adapted to promote escape of the feeler 11 from the notches 10 in the phase of return to rest of the plates.

Figure 2C:
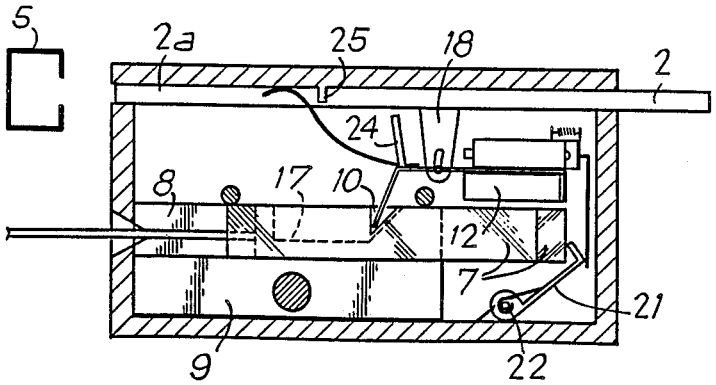
Figure 2D:
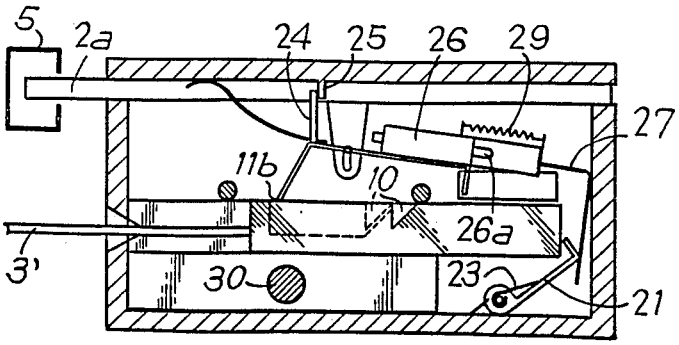

When an ill-disposed person seeks to make the lock operate with a wrong key 3', the introduction of this key does not produce the alignment of the notches 10 of the plates 7 (FIG. 2*d*). However, the wrong key pushes the latter, just like the authentic key 3, but without taking along the feeler 11, which, not having pivoted in the aligned notches, remains retained by stop of a part 24, which it comprises in projection, against a fixed catch 25, fast with the housing 1, with the result that the rod 2 is not actuated.

The fact that the feeler 11 in that case does not accompany the plates 7 in their overall displacement, is detected by a small switch 26 mounted on the feeler and possessing a control lug 26*a* actuated by a crank arm 27 pivoting about an articulation 28. The end of this arm cooperates with the blade 21, which, on pivoting, may cause it to pivot against the force of a return spring 29 ensuring a permanent pressure on the lug 26*a* for actuating the switch 26.

When the wrong key 3' is introduced into the lock, the plates 7 cause the blade 21 to pivot, this causing the arm 27 to pivot with respect to the switch 26, moving it away therefrom (FIG. 2*d*) with the result that the pressure on the lug 26*a* disappears and the switch 26 operates, indicating in any appropriate manner, by closure of an electric circuit, the illicit attempt to open the lock.

On the other hand, when it is the authentic key 3 which is used, there is no relative movement between the feeler 11 and the plate assembly 7, therefore none between the switch 26 and its actuation arm 27 either (cf. FIGS. 2*b* and 2*c*), with the result that the switch does not operate and no alarm is triggered off.

It will be noted that it is possible to modify, if necessary, the code allocated to the lock: it suffices to open the housing and to change the order and/or the type of plates 7 of the identification assembly. Furthermore, the choice of a binary code in the example described is in no way limiting.

Figure 3:
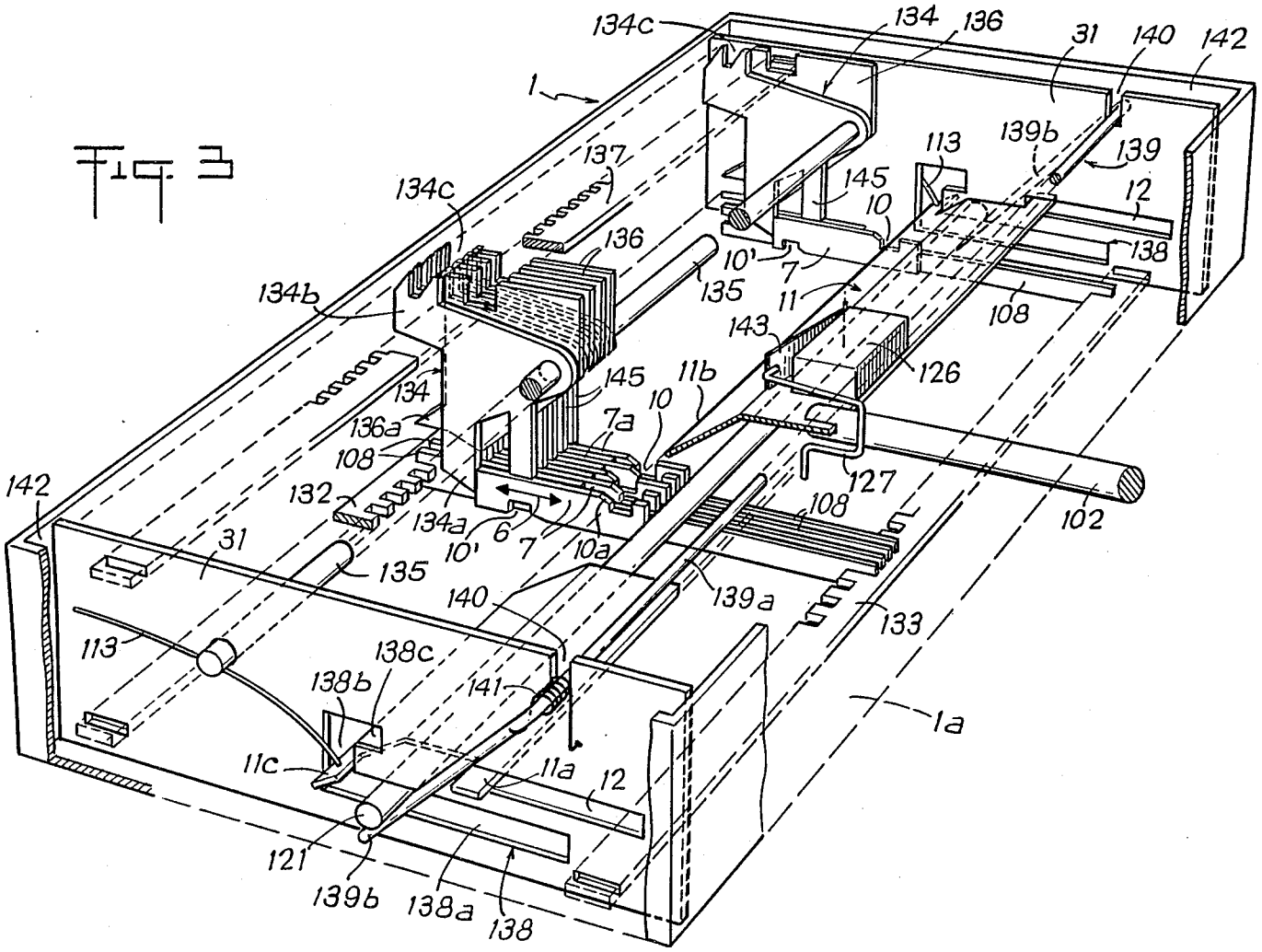
FIG. 3 schematically shows, in perspective, a variant embodiment of the lock.

The lock shown in FIG. 3 comprises, like the lock of FIG. 1, in a housing 1, an assembly of identification plates 7 in the form of an elongated rectangle, comprising, on their longitudinal side 7*a* facing the mobile feeler 11, a coding notch 10. Each of the notches may occupy one or the other of two predetermined positions over the length of the side 7*a*, with the result that the series of notches 10 is disposed in accordance with a binary code peculiar to the lock when the plates 7 are in rest position. There again, the feeler 11 presents a pair of lugs 11*a* engaged in slots 12 made, parallel to the longitudinal direction 6 of the plates 7, in two parallel walls 31 inside the housing 1.

However, it will be noted that the plates 7 of the present embodiment have a length reduced almost by half: they extend only by little beyond their notch 10. In addition, the spacer members 9 have been eliminated, the plates 7 now sliding directly on the bottom 1*a* of the housing 1, and the small separating plates 8 make room for oblong spacer members 108 of which the pitch is determined by fitting, at their ends—each provided with a notch—in the rack notches 132, 133 fixed transversely between the walls 31.

However, the principal difference resides in the addition of an assembly of pivoting parts 134 for attacking the plates 7 and causing them to slide under the action of a flat key introduced into the lock. Parts 134 are identical bevel gear parts, mounted independently on a common pivot pin 135; they are flat, of thickness substantially equal to that of the plates 7, and with each of the latter there is associated a part 134 located in the same plane. The pitch of the parts 134 is maintained equal to that of the plates 7 on the one hand by spacer members 136 fitted in the notches of a rack 137 and traversed by the pin 135, and on the other hand by the spacer members 108 of which the ends adjacent the rack 132 pass between arms 134*a* belonging to parts 134, by which the latter attack the ends 7*b* of the plates 7. Each part 134 comprises a second arm 134*b* oriented substantially at right angles with respect to the arm 134*a* and provided with a notch 134*c* for receiving the key.

It will also be noted that the pivoting blade 21 for returning the plates 7 to rest is replaced by a transverse bar 121, adapted to move in translation in direction 6 in first parts 138*a* of guiding slots 138 made in the walls 31. The bar 121 is stressed towards the plate 7 assembly by means of a pivoting stirrup 139 with elastic return. This stirrup comprises a transverse rod 139*a* engaged in notches 140 of the walls 31 and bent at its ends to form arms 139*b* which may pivot in gaps 142 separating the walls 31 and the housing 1, about an axis materialized by rod 139*a*, under the action of at least one spring 141 wound around one end of the rod 139 and attached by radial ends respectively to arm 139*b* and to wall 31 which correspond thereto.

In order to ensure an action without dissymetry of the plates 7 on the bar 121 so that the latter moves in all cases parallel to itself, it is arranged so that there is always, during the stroke of positioning of the plates 7, advance of two plates located respectively at the ends of the identification assembly. In other words, the coded edges of the keys 3 systematically comprise a tooth 16 in the region of each of their ends.

The feeler 11 presents, at the ends of its drive edge 11*b* by which it may come into mesh with the aligned notches 10 of the plates 7, a second pair of lateral lugs 11*c* which are respectively engaged in slots 138. The first part 138*a* of the latter, long and parallel to direction 6, is extended, at its end adjacent the plate 7 assembly, by a second, shorter part 138*b*, oriented perpendicularly, then by a third part 138*c*, even shorter, parallel to the first part 138*a* (so that each slot 138 has the form of a J). Furthermore, the edge 11*b* of the feeler 11 is maintained applied against the sides 7*a* of the plate 7 assembly by a pair of leaf springs 113 located in the gaps 142, fixed to the lugs 11*c* and abutting on the ends of the pin 135 which project in these gaps.

In order to operate the lock, the key 3 may be introduced either, as in the case of the lock of FIG. 1, parallel to direction 6, the key then acting on the plates 7 via the arms 134*a* of the parts 134, or perpendicularly to direction 6, the key then acting via the arms 134*b* and 134*a* of the parts 134. In both cases, these latter pivot about pin 135, rotating on more or less large angles depending on whether each is attacked by a tooth or by a hollow of the coded edge 3*a* of the key 3, with the result that the code of the key is transmitted to the plate 7 assembly by all the pivoting parts 134. In the first case of introduction of the key, the latter is guided between the spacer members 108 and the nose elements 136*a* that the spacer members 136 comprise in the vicinity of the corresponding inlet slot 4 in the housing 1 of the lock. In the second case where the key 3 is introduced through a second slot 144 made in the lid 1*b* of the housing 1, it is notches 134*c* of arms 134*b* which guide the key during the movement of pivoting of parts 134. In practice, the slot 144 is accessible from outside the premises defended by the lock, while the slot 4 is accessible from inside.

Apart from this double possibility of introduction of the key, operation of the lock of the present example is the same as that of the lock of FIG. 1. By progressive penetration of the key, the notches 10 of the plates 7 are aligned, the bar 121 being shifted rearwardly by rearward movement of plates 7 a distance in accordance with the depth of the teeth of the key in advance of movement of feeler 11. The feeler 11 then pivots in the aligned notches, then is also driven in translation by the plates 7 accomplishing their complementary stroke, guided by its first pair of lugs 11*a* in the slots 12 and by its second pair of lugs 11*c* in the first part 138*a* of the slots 138. The feeler then repels the bolt control member which is constituted by a sliding rod 102 coupled to the feeler by simple fork link.

If the key introduced into the lock does not comprise the correct code, its penetration causes the displacement only of the bar 121, the feeler remaining immobile, retained by its lugs 11*c* in the second part 138*b* of the slots 138. At the end of the stroke that would have produced the alignment of the notches if the key used had been authentic, the bar 121 encounters a flexible rod 127 which actuates, via an articulated blade 143, a mini-switch 126 fixed on the feeler 11, which triggers off an alarm. The edge of the notches 10 by which the latter are capable of driving the feeler 11 during their complementary stroke is provided with a small bevel 10*a* which ensures slide without hindrance, under the thrust of the wrong key, of each plate 7 with respect to the feeler 11, blocked by its lugs 11*c* in the second part 138*b* of the slots 138, even if the drive edge 11*b* of the feeler were somewhat deformed or locally offset to the point of slightly penetrating in one or more notches 10 while not all the notches are aligned. This arrangement ensures that no wrong key will be stopped in untimely manner in its stroke of penetration, and will therefore cause, with complete certitude, the actuation of the alarm mini-switch 126.

Figure 4:
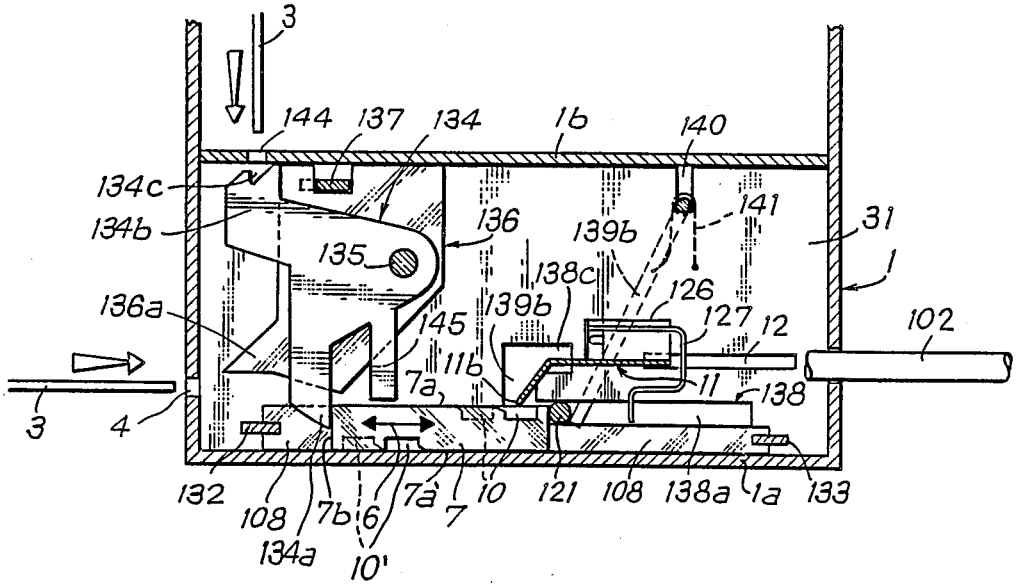
FIG. 4 shows a longitudinal section of the lock of FIG. 3 in rest position.

As may be seen in FIGS. 3 and 4, the plates 7 comprise a coding notch not only on their longitudinal side 7*a* facing the feeler 11, but on their opposite side 7*a*′ where there is provided a second notch 10′. The notches 10 and 10′ are respectively located in the vicinity of the ends of each plate 7, but at a different distance, so that one corresponds to a binary 1 and the other to a binary 0. One or the other of the notches 10, 10′ of each plate may be used as desired by simply turning the plate in its plane. This operation is simple to perform, as the blades 7 are maintained in position against the bottom 1*a* of the housing 1 only by their ends, namely at one end by the feeler 11 and the bar 121 which abut elastically thereon and, at the other end, by protuberances 145 that the parts 134 comprise, oriented substantially radially with respect to the axis 135 and allowing the plates 7 only a slight clearance to move away from bottom 1*a*. Consequently, after having removed the lid 1*b*, it suffices to lift the feeler 11 and to immobilize it in a position of retraction where its lugs 11*c* are housed and retained in the third part 138*c* of the slots 138. The plates 7 of which it is desired to reverse the binary coding 0 or 1 may then be withdrawn, turned and returned into position without the corresponding protuberances 145 opposing this.

What is claimed is:

1. A lock assembly for controlling a bolt comprising a lock and a key, said lock comprising a plurality of elongate generally rectangular spaced parallel plates slideably mounted for movement inwardly in a longitudinal direction, said plates including a longitudinal end surface positioned to be engaged for inward movement with insertion of said key in said lock and a side surface portion disposed parallel to said longitudinal direction, said side surface portions of said plates being disposed in coplanar alignment, notches formed in said side surfaces of said plates at one of several predetermined positions therealong, the notches of said plates being adapted to be shifted into alignment responsive to insertion of said key in said lack a feeler member biased against said side surfaces, said feeler member being adapted to enter into said notches when the same are aligned and to be coupled with said plates in said entered position, said feeler member being shiftably mounted in said longitudinal direction, bolt control means coupled to said feeler member and said bolt for shfiting said bolt inwardly to an opening position in said longitudinal direction responsive to movement of said feeler member inwardly in said longitudinal direction, and means for returning said bolt control means, said bolt, said plates, and said feeler member to the locked position thereof responsive to removal of said key.

2. A lock according to claim 1 and including stop means in the path of said feeler member for preventing said feeler member from moving inwardly in said longitudinal direction, unless said feeler member is disposed in said aligned notches of said plates.

3. A lock in accordance with claim 1 wherein said feeler member is mounted for pivotal movement substantially perpendicularly to the plane defined by said side surfaces.

4. A lock in accordance with claim 3 and including parallel side walls, the pivot axis of said feeler member being defined by a pair of lateral lugs, said lugs being mounted in parallel slots formed in said side walls, said slots being aligned with said longitudinal direction.

5. A lock in accordance with claim 4 wherein said feeler member includes a second pair of lateral lugs, said second pair of lugs projecting into a second pair of slots formed in said side walls, said second pair of slots including first portions parallel to said plates, and second portions perpendicular to said plates, said feeler member abutting the walls defined by said second portions in the locked position of said lock.

6. A lock in accordance with claim 1 and including alarm means positioned to be activated responsive to movement of said plates in said longitudinal direction when unaccompanied by concomitant movement of said feeler in said longitudinal direction.

7. A lock in accordance with claim 6 wherein said alarm means comprises a switch having a body in fixed position relative to said feeler member and a contact movable relative to said feeler member, said contact being positioned to be shifted responsive to movement of at least one said plate of a predetermined magnitude relative to said feeler member.

8. A lock in accordance with claim 1 and including a plurality of levers mounted for pivotal movement about a common axis perpendicular to said plates, each said lever including a first arm engaging an end surface of a said plate and a second arm angularly oriented with respect to said first arm, key slot means in said lock in registry with said second arms of said levers, whereby movement of said key against said second arms pivots said levers and shifts said plates in said longitudinal direction.

9. A lock in accordance with claim 1 wherein said notches in said plates include a shoulder perpendicular to said longitudinal direction at the portion of said notch nearest said end surface, and a second shoulder angularly oriented with respect to said longitudinal direction.

10. A lock in accordance with claim 1 wherein said key comprises a generally flat member having a front edge, said front edge including cut-outs defining teeth and hollows, the spacing of said teeth and hollows corresponding with the spacing of said plates.

11. A lock in accordance with claim 10 wherein said cut-outs define a binary coding, each said plate having its notch located in one of two predetermined locations along its length in accordance with the coding of said key.

12. A lock in accordance with claim 1 and including transverse bar means biased against the ends of said plates remote from said end surface for returning said plates to said locked position responsive to removal of said key from said lock.

* * * * *